US007264193B2

(12) United States Patent
Hikita

(10) Patent No.: US 7,264,193 B2
(45) Date of Patent: Sep. 4, 2007

(54) CHANGEOVER DEVICE AND METHOD FOR CHANGING OVER WINDING OF WEB

(75) Inventor: Shinji Hikita, Kanagawa (JP)

(73) Assignee: Fujifilm Corporation, Ltd., Tokyo (JP)

( * ) Notice: Subject to any disclaimer, the term of this patent is extended or adjusted under 35 U.S.C. 154(b) by 0 days.

(21) Appl. No.: 10/941,854

(22) Filed: Sep. 16, 2004

(65) Prior Publication Data

US 2005/0077415 A1 Apr. 14, 2005

(30) Foreign Application Priority Data

Sep. 19, 2003 (JP) ..... 2003-328955

(51) Int. Cl.
*B65H 35/04* (2006.01)

(52) U.S. Cl. ..... 242/527.2; 242/532.3

(58) Field of Classification Search ..... 242/527, 242/527.1, 527.4, 527.7, 532.4, 533.4, 532.3, 242/527.2
See application file for complete search history.

(56) References Cited

U.S. PATENT DOCUMENTS 3,552,670 A 1/1971 Herman
4,529,141 A * 7/1985 McClenathan ..... 242/527.1
5,368,253 A * 11/1994 Hartley, Jr. ..... 242/527.4
5,660,349 A * 8/1997 Miller et al. ..... 242/526.1

FOREIGN PATENT DOCUMENTS

EP 600514 A2 * 6/1994
EP 0 842 882 A 5/1998
EP 842882 A1 * 5/1998
JP 8-157112 A 6/1996
JP 11-171377 A 6/1999

* cited by examiner

*Primary Examiner*—Patrick Mackey
*Assistant Examiner*—William E. Dondero
(74) *Attorney, Agent, or Firm*—Birch, Stewart, Kolasch & Birch, LLP

(57) ABSTRACT

A web winder of a turret winding type is provided with a first spindle secured to a first drive shaft. A second spindle is secured to a second drive shaft. Positions of the first and second drive shafts are changeable in the web winder. A changeover device changes over winding of a web wound about the first spindle to winding about the second spindle. A cutting drum is disposed on a first side with respect to a web path of the web, and has a cutter for cutting the web in a width direction thereof. A receiving drum is disposed on a second side with respect to the web path opposite to the first side. A drum support arm supports the cutting and receiving drums in a rotatable manner and in a manner of contacting drum peripheral surfaces of the cutting and receiving drums on each other.

20 Claims, 11 Drawing Sheets

CHANGEOVER DEVICE AND METHOD FOR CHANGING OVER WINDING OF WEB

This Non-provisional application claims priority under 35 U.S.C. § 119(a) on Patent Application No(s). 2003-328955 filed in Japan on Sep. 19, 2003, the entire contents of which are hereby incorporated by reference.

BACKGROUND OF THE INVENTION

1. Field of the Invention

The present invention relates to a changeover device and method for changing over winding of a web. More particularly, the present invention relates to a changeover device and method for changing over winding of a web, in which the web with an extremely small thickness can be treated safely without breakage, wrinkles or other damages.

2. Description Related to the Prior Art

There are various types of web winders for winding a web or continuous material about a spindle, for example paper, plastic film or the like. It is important in the web winder to wind the web continuously without stopping its flow, in view of time required for the operation, management of the production, and the like.

JP-A 8-157112 and JP-A 11-171377 disclose an example of the web winder for automatically winding the web traveling continuously. JP-A 8-157112 cuts the web partially wound about a first spindle. After this, an upstream web section from the web is changed over to a second spindle, which continuously winds the upstream web section. For the purpose of winding the web about the second spindle, an end of the upstream web section is attached by a sheet applicator to a leading sheet or guide leader extending from the second spindle. For suitable attachment, the sheet applicator must move at an equal speed to that of the web. According to JP-A 8-157112, the sheet applicator is stationary in the web winder. Part of the web being transported near to the sheet applicator is retained in a temporary manner by a nipping mechanism, for the purpose of the attachment. An accumulator is positioned upstream from the nipping mechanism, and stores the web transported during the attachment, so as to keep a continuous flow of the web.

In the web winder in JP-A 11-171377, there is no use of the accumulator. The web winder automatically winds the web continuously transported. A nipping roll and a spindle nip the web. A portion of the web is cut on a cutting line downstream from the nipping position. At the same time as the cutting, the web is attached to the spindle with double-sided adhesive tape previously adhered to the spindle, for the purpose of changeover operation. Then rotation of the spindle winds the web.

However, a problem arises in the sue of the accumulator of JP-A 8-157112. When the web is moved at a high speed, a required stored amount of the web increases. The web winder may be very complicated and have a remarkably large size. It is likely that no suitable tension is applied to the web when the accumulator is operated. Wrinkles may occur in the web.

In JP-A 11-171377, the web is cut at a cutting point that is in front of a position of attaching the adhesive tape. A front end of the web remains free in front of the attaching position. As the web is remarkably thin and has a low rigidity, the web may have wrinkles or folds in contact with the spindle.

SUMMARY OF THE INVENTION

In view of the foregoing problems, an object of the present invention is to provide a changeover device and method for changing over winding of a web, in which the web with an extremely small thickness can be treated safely without breakage, wrinkles or other damages.

In order to achieve the above and other objects and advantages of this invention, a changeover device for changing over winding of a web wound about a first spindle to winding about a second spindle, in a web winder of a turret winding type, is provided. The first spindle is secured to a first drive shaft, the second spindle is secured to a second drive shaft, positions of the first and second drive shafts are changeable in the web winder. In the changeover device, a cutting drum is disposed on a first side with respect to a web path of the web, and having a cutter for cutting the web in a width direction thereof. A receiving drum is disposed on a second side with respect to the web path opposite to the first side. A drum support mechanism supports the cutting and receiving drums in a rotatable manner and in a manner of contacting drum peripheral surfaces of the cutting and receiving drums on each other.

Furthermore, a shifter shifts the drum support mechanism between a changeover position for causing the drum peripheral surface of the receiving drum to contact the second spindle, and a ready position for keeping the drum peripheral surface of the receiving drum away from the web becoming wound about the second spindle. A path forming unit is disposed between the cutting and receiving drums, for enabling the web to pass in a non-contact manner from the cutting and receiving drums.

At least one of the cutting and receiving drums includes a first portion for constituting the drum peripheral surface at least partially. A second portion has a smaller radius than the drum peripheral surface, for constituting the path forming unit.

Furthermore, a rotation control unit is actuated when the drum support mechanism is set in the changeover position, for causing the cutting and receiving drums to make one rotation.

The rotation control unit causes the cutting and receiving drums to rotate at a peripheral speed equal to a web moving speed of the web.

According to one preferred embodiment, the path forming unit includes a mechanism for moving the cutting drum away from the receiving drum.

Furthermore, a rotation control unit is actuated when the drum support mechanism is set in the changeover position, for causing the cutting and receiving drums to make one rotation.

The web is adhered with adhesive material to one of the spindles.

According to another preferred embodiment, an adhesive sheet material is stuck to the cutting drum, for adhesion of the web to one of the spindles, and the adhesive sheet material includes a first adhesive surface for sticking to the cutting drum, and a second adhesive surface, having higher strength of adhesion than the first adhesive surface, for adhesion to the web.

The cutter protrudes from the drum peripheral surface of the cutting drum, and the receiving drum includes a receiving slot for receiving entry of the cutter.

The receiving drum includes a surface material of rubber positioned on the drum peripheral surface thereof.

Furthermore, there is a suction unit for suction of the web close to an upstream edge of the receiving slot upstream with respect to a drum rotational direction of the receiving drum.

Furthermore, a front end biasing unit is disposed close to an upstream side of the cutter upstream with respect to a drum rotational direction of the cutting drum, for biasing a front end of the web being cut toward the receiving drum.

The front end biasing unit comprises an air blowing mechanism or sponge material.

The web winder includes at least first and second turret arms, disposed to extend radially from a turret axis, for supporting respectively the first and second drive shafts at ends thereof. A turret rotation control unit sets the first and second turret arms selectively in first and second turret positions by rotation thereof about the turret axis. There is a controller for operation in first and second steps alternately. The controller in the first step controls the first drive shaft on the first turret arm in the first turret position to wind the web about the first spindle, the second turret position being adapted to initially setting the second spindle in an unused state. The controller in the second step drives the turret rotation control unit for rotationally setting the second turret arm in the first turret position, and for rotationally setting the first turret arm in the second turret position, to allow removal of a roll of the web being wound from the first drive shaft. The receiving drum is positioned near to the first turret position, and the drum support mechanism is set in the changeover position after the second step and before the first step.

Also, a changeover method, of changing over winding of a web wound about a first spindle to winding about a second spindle in a web winder of a turret winding type, is provided. The first spindle is secured to a first drive shaft, the second spindle is secured to a second drive shaft, positions of the first and second drive shafts are changeable in the web winder. In the changeover method, a cutting drum and a receiving drum are used, the cutting drum being disposed on a first side with respect to a web path of the web, and having a cutter for cutting the web in a width direction thereof, and a small-radius portion free from contact with the web, the receiving drum being disposed on a second side with respect to the web path opposite to the first side, and having a small-radius portion free from contact with the web. The cutting and receiving drums are supported with a drum support mechanism in a rotatable manner and in a manner of contacting drum peripheral surfaces of the cutting and receiving drums on each other. The cutting and receiving drums are stopped when the drum peripheral surfaces thereof are opposed to each other, to form a space for passage of the web in a non-contact manner. The drum support mechanism are shifted between a changeover position for causing the drum peripheral surface of the receiving drum to contact the second spindle, and a ready position for keeping the drum peripheral surface of the receiving drum away from the web becoming wound about the second spindle. Upon setting the drum support mechanism in the changeover position, the cutting and receiving drums are caused to make one rotation, to cut the web. A front end of the web being formed by cutting is secured to the second spindle, for changing over winding.

According to the present invention, the web with an extremely small thickness can be treated safely without breakage, wrinkles or other damages, because of suitable operation of changeover by use of the cutting and receive drums and the drum support mechanism.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
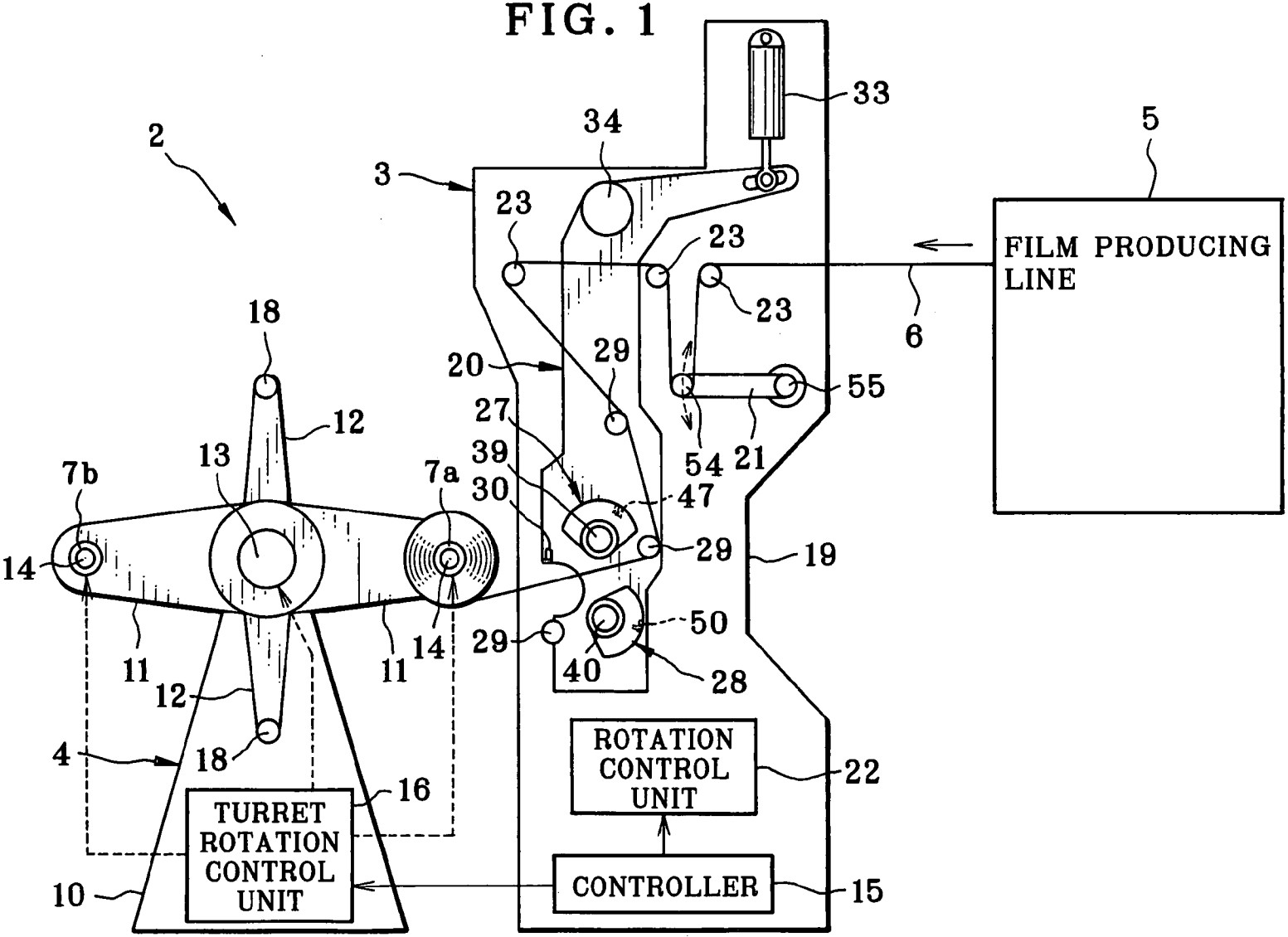
FIG. 1 is a front elevation illustrating a changeover device.

In FIG. 1, a web winder 2 of a type of turret winder includes a changeover device 3 and a winder body 4. Various apparatuses are arranged in a film producing line 5. Among those, the web winder 2 is a finally used apparatus. A web 6 is wound about a selected one of first and second spindles 7*a* and 7*b* after continuous transport in the film producing line 5. It is noted that the web winder 2 can be used for other purposes, for example in a line for applying a coating.

The winder body 4 has a frame or stand 10. Turret arms 11 and guide arms 12 are disposed on the stand 10 and are rotatable about a turret axis 13. Drive shafts 14 are incorporated in respectively an end of the turret arms 11. The drive shafts 14 are loaded with the first and second spindles 7*a* and 7*b* in a removable manner. The turret arms 11 are caused by a turret rotation control unit 16 with a motor to make half a rotation intermittently at each time of changeover of the web 6 to an unloaded spindle. Also, the turret rotation control unit 16 is controlled by a controller 15 to cause the drive shafts 14 to rotate. An example of the turret rotation control unit 16 is constituted by a motor driver, a servo motor, and a motion transmitting mechanism, the servo motor including a rotary encoder.

Note that a first turret position is defined for a regular winding position where the first spindle 7*a* in FIG. 1 winds the web in the vicinity of the changeover device. Let a second turret position be an exchange position which is away from the changeover device and where the second spindle 7*b* is exchanged by a renewing operation.

When the web roll of the web 6 comes to have a fully wound state about the first spindle 7*a*, the turret arms make half a rotation, to change positions of the first and second spindles 7*a* and 7*b* to each other. See FIG. 2. After changeover of the web 6 from the first spindle 7*a* to the second spindle 7*b*, the first spindle 7*a* is removed from the drive shaft 14. A second spindle of an unloaded state is set on the drive shaft 14 in place of the first spindle 7*a*.

A term of the fully wound state is used to refer to a state of the web roll having a predetermined diameter of the web 6 about a spindle. When the fully wound state is obtained, the controller 15 detects this state. The controller 15 considers a predetermined spindle diameter, and a predetermined thickness of the web 6, responds to a signal for the number of rotations output by the rotary encoder, and calculates the diameter of the web roll. Double-sided adhesive tape 17 with a tacky adhesive material is attached to the second spindle 7*b* in the unloaded state. See FIG. 5. The web 6 can be attached to the second spindle 7*b* by use of the double-sided adhesive tape 17.

The guide arms 12 rotate together with the turret arms 11. Guide rollers 18 are positioned on ends of the guide arms 12.

In FIG. 1, the changeover device 3 includes a frame 19, a drum support arm 20, a dancer arm 21, the controller 15, a rotation control unit 22 with motors, and plural pass rolls 23. The drum support arm 20 is provided with a cutting drum 27, a receiving drum 28, plural pass rolls 29, and a tape detection sensor 30. Note that the tape detection sensor 30 may be disposed on the turret arms 11.

An arm shaft 34 keeps the drum support arm 20 pivotally movable on the frame 19. A shifting cylinder 33 sets the drum support arm 20 in a selected one of a ready position of FIG. 1 and a changeover position of FIG. 2. Note that the changeover position for the drum support arm 20 is adjustable by an initial setting in consideration of a target diameter of a spindle.

Figure 2:
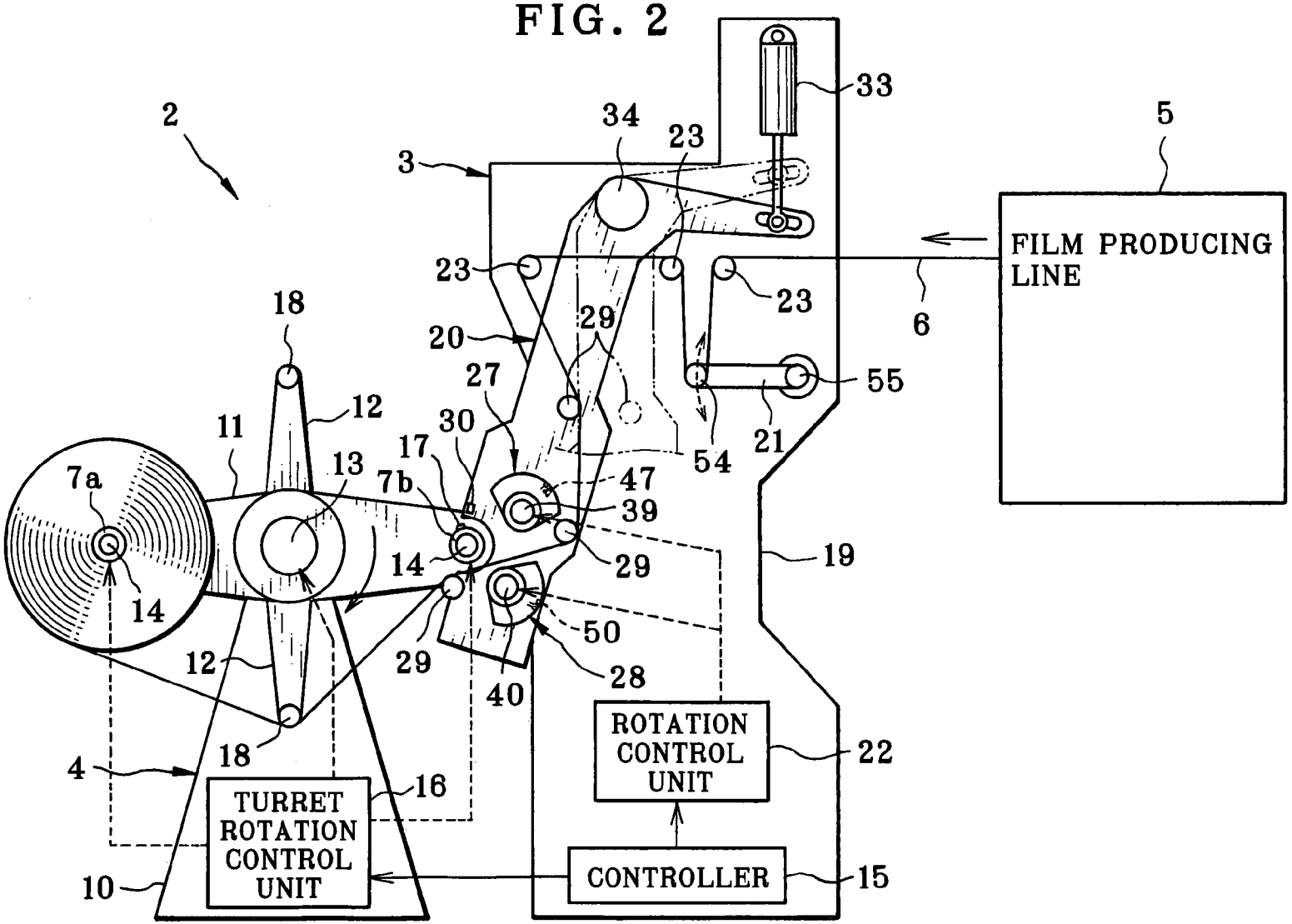
FIG. 2 is a front elevation illustrating a state of the changeover device for changing over the winding.

In FIG. 2, the pass rolls 29 guide the web 6 between the cutting drum 27 and the receiving drum 28. A form of the cutting and receiving drums 27 and 28 as viewed in a cross section is a sector shape. Drum shafts 39 and 40 of the drums keep those rotatable on the drum support arm 20. While the drums are stopped, the gap portions of those retreating from their peripheral surfaces operate as a path forming unit, with which the web 6 moves without contacting the drums. In contrast with this, while the drums rotate, drum peripheral surfaces 41 and 42 of FIG. 5 nip the web 6 being transported. When the drum support arm 20 is in the changeover position as illustrated in FIG. 2, a spindle surface 43 of the spindle of FIG. 5 and the drum peripheral surface 42 nip the web 6 in rotations of the receiving drum 28.

The cutting drum 27 and the receiving drum 28 on the drum support arm 20 are rotated in synchronism by the rotation control unit 22 receiving a command signal from the controller 15. An example of the rotation control unit 22 is constituted by a motor driver, a servo motor, and a motion transmitting mechanism, the servo motor including a rotary encoder. The motor driver responds to the command signal from the controller 15, and determines a level of current or voltage according to which driving of the servo motor is controlled. Then the servo motor causes the cutting and receiving drums 27 and 28 to rotate. In FIG. 2, the broken lines indicate transmission of the force of driving. When the cutting and receiving drums 27 and 28 rotate, pulse signals are generated by the rotary encoder and sent to the controller 15. The pulse signals are counted in the controller 15, to obtain amounts of rotation of the cutting and receiving drums 27 and 28, for control of the cutting and receiving drums 27 and 28. For the changeover of the winding of the web, the number of rotations of the cutting and receiving drums 27 and 28 is only one. The cutting drum 27 makes one clockwise rotation about the drum shaft 39. The receiving drum 28 makes one counterclockwise rotation about the drum shaft 40. Speeds of the cutting and receiving drums 27 and 28 are controlled so that peripheral speeds of those are equal to the web moving speed at the time of nipping. Thus, the cutting and receiving drums 27 and 28 at the start of the rotation are accelerated in an instantaneous manner. Note that a clutch mechanism can be added to the rotation control unit 22, and can control the torque to be applied to the cutting and receiving drums 27 and 28 in driving the cutting and receiving drums 27 and 28.

Figure 3:
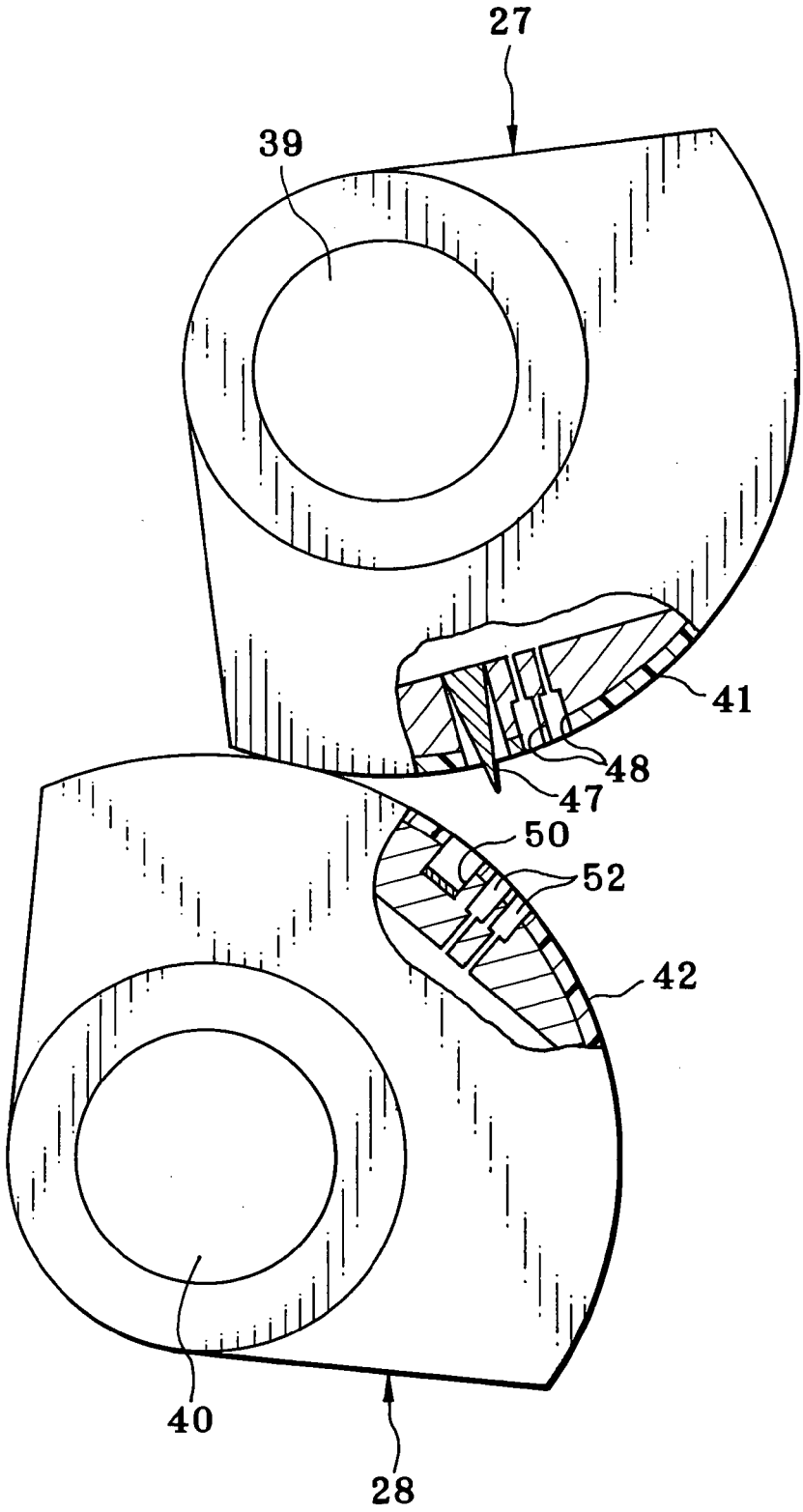
FIG. 3 is a front elevation, partially cutaway, illustrating cutting and receiving drums.

In FIG. 3, the cutting drum 27 is provided with a cutter 47 and plural air nozzles 48 with a blower or fan for the purpose of biasing the front end. The cutter 47 is set on the drum peripheral surface 41 in a direction parallel to the Drum shaft 39, or with an inclination of 0-5 degrees with reference to the direction of the drum shaft 39. The air nozzles 48 are positioned upstream from the cutting drum 27 in the rotational direction in the vicinity of the cutter. The air nozzles 48 are formed in the drum peripheral surface 41, and adapted for air blowing. Timing of the air blow is controlled by the controller 15. Surface material or lining material for the drum peripheral surface 41 is rubber. Note that a structure for biasing the front end of the web may be a sponge material, sponge rubber material or the like in place of the air nozzles 48. Furthermore, the surface material for the drum peripheral surface 41 may be metal, plastic, paper or the like instead of the rubber.

There are a receiving slot 50 and a suction unit or suction mechanism 52 provided in the receiving drum 28. The receiving slot 50 is formed in the drum peripheral surface 42, and extends in a direction parallel to the drum shaft 40 or with an inclination of 0-5 degrees as viewed from the drum shaft 40. This is similar to the inclination of the cutter 47 of the cutting drum 27. For an inner surface of the receiving slot 50, a lower portion of the inside of the receiving slot 50 is formed from metal, so as to cut the web 6 upon entry of the cutter 47 into the receiving slot 50. The suction mechanism 52 is positioned upstream from the receiving drum 28 in a rotational direction in the vicinity of the receiving slot 50. Plural holes are formed in the drum peripheral surface 42, and adapted for air suction of the suction mechanism 52, for the purpose of retaining a front end of the web by suction after the cutting. Timing of the air suction is controlled by the controller 15. Surface material or lining material for the drum peripheral surface 42 is rubber, so as to keep the surface of the second spindle 7*b* free from scratches even in incidental contact with the second spindle 7*b*.

In FIG. 2, a dancer roll 54 is positioned at a first arm end of the dancer arm 21. A pivot 55 on the frame 19 keeps the dancer arm 21 rotatable about a second arm end. There is a potentiometer (not shown) associated with the dancer arm 21 for detecting its rotational position. The dancer roll 54 has weight which applies prescribed tension to the web 6 under gravity. The dancer roll 54 moves up when a rotational speed of the drive shaft 14 becomes higher, and moves down when the rotational speed of the drive shaft 14 becomes lower. The dancer arm 21 is rotated about the pivot 55 by the moving up and down of the dancer roll 54. The potentiometer detects changes in the angle, and sends a detection signal to the controller 15. The controller 15 responsive to the detection signal controls a drive device associated with the drive shaft 14, to adjust the web moving speed of the web.

The operation of the above construction is described. The web 6 produced by the film producing line 5 is transported in the arrow direction of FIG. 1. The web 6 passes positions of the pass rolls 23 in the frame 19 and the pass rolls 29 on the drum support arm 20, and becomes wound by the first spindle 7*a* positioned regularly. If the web roll does not have the fully wound state yet, the drum support arm 20 is in the ready position of FIG. 1. The web 6 is transported between the cutting drum 27 and the receiving drum 28. Gap portions are formed in respectively the cutting and receiving drums 27 and 28 to retreat from their peripheral surface, so the web 6 does not contact the cutting drum 27 or the receiving drum 28. While the web 6 becomes wound, the tension applied to the web 6 is controlled and kept constant.

Figure 4:
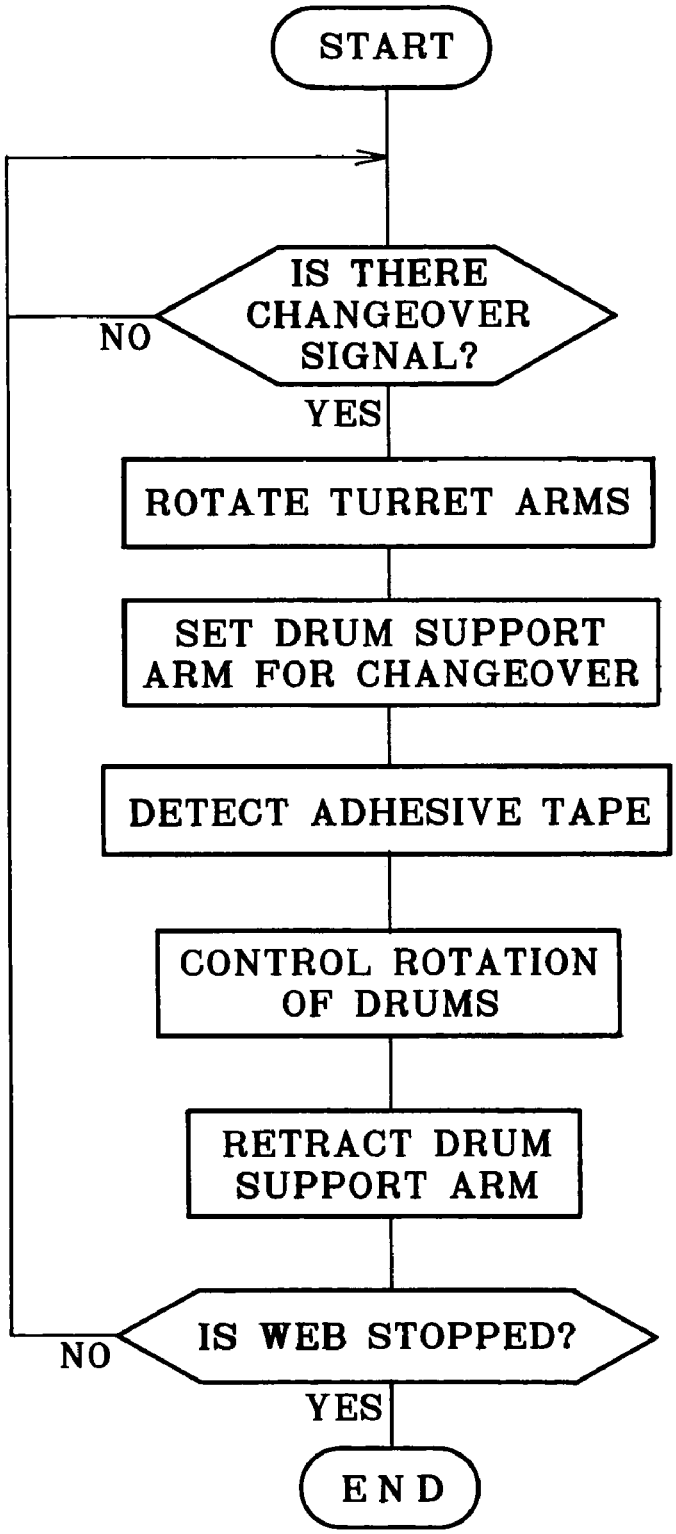
FIG. 4 is a flow chart illustrating winding operation.

At the same time, the controller 15 determines a diameter of the web roll according to the number of rotations of the first spindle 7*a* counted after the takeup of the web 6 to the first spindle 7*a*. When the winding of the web 6 proceeds to cause the roll diameter to come up to the predetermined diameter, then the fully wound state of the web roll is recognized. The controller 15 generates a changeover signal. In FIG. 4, this sequence is illustrated in a flow chart. In response to the changeover signal, the controller 15 sends a signal to the winder body 4, to cause the turret arms 11 and the guide arms 12 to make half a rotation in the clockwise direction. Then the second spindle 7*b* in the unloaded state is set in the first turret position with the double-sided adhesive tape 17 attached to the spindle surface. The second spindle 7*b* rotates at a peripheral speed that is equal to or slightly higher than a web moving speed of the web 6.

When the turret arms 11 make half a rotation which is 180 degrees, the controller 15 sends a control signal to the shifting cylinder 33. The shifting cylinder 33 is driven, to shift the drum support arm 20 from the ready position to the changeover position.

When the drum support arm 20 shifts to the changeover position, the controller 15 responds to a signal from the tape detection sensor 30, and generates a start command signal for starting rotations of the cutting drum 27 and the receiving drum 28. The start command signal is in such a form as to place and attach the front end of the upstream web section to the double-sided adhesive tape 17 after cutting. The cutting and receiving drums 27 and 28 are instantaneously accelerated, and rotated at the peripheral speed equal to the web moving speed. During one rotation, the web 6 is changed over from the first spindle 7*a* to the second spindle 7*b* in the unloaded state. Main elements of the web winder 2 will be hereinafter described by referring to FIGS. 5-10.

Figure 5:
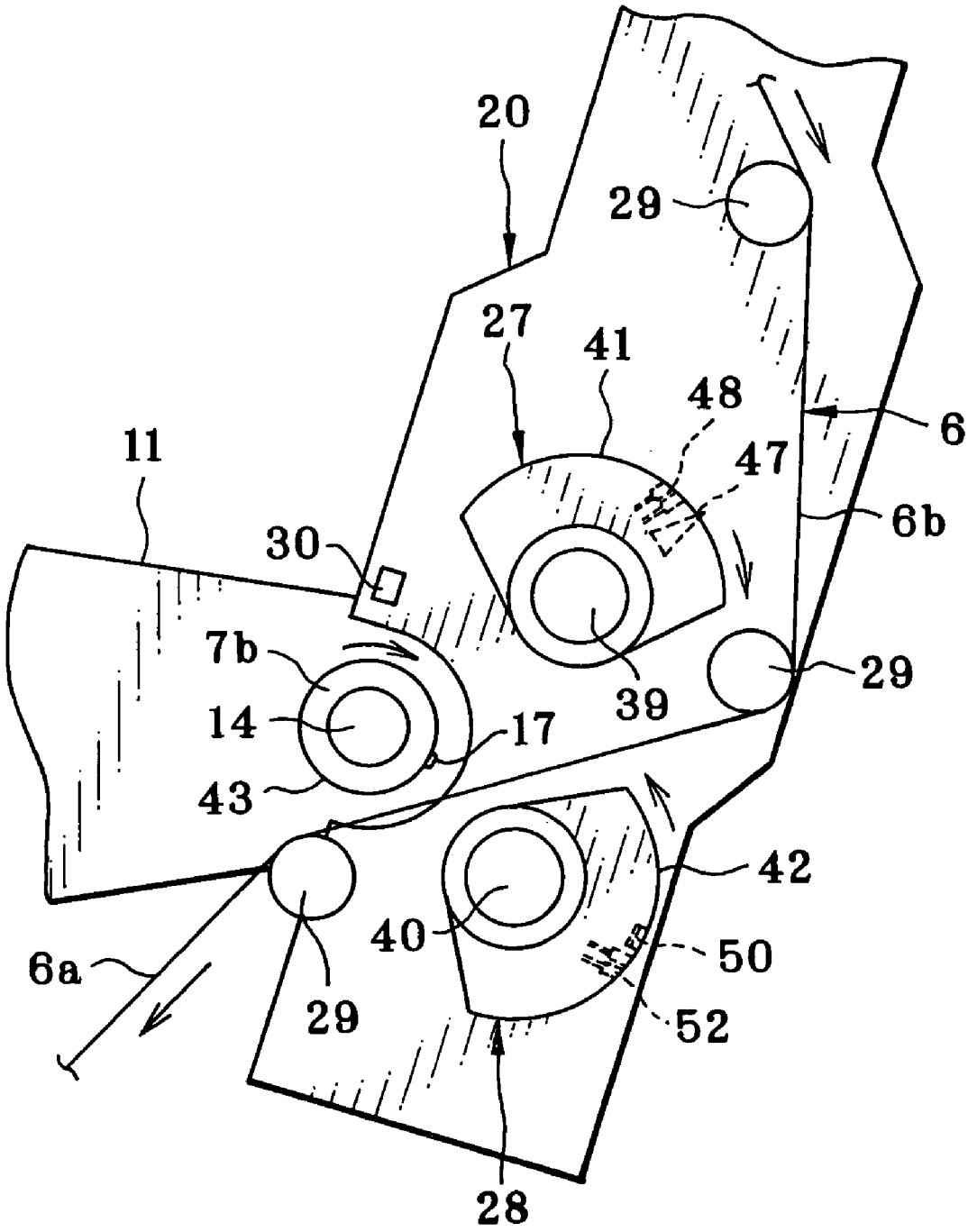
FIG. 5 is a front elevation, partially broken, illustrating a state immediately after setting in a changeover position.
Figure 6:
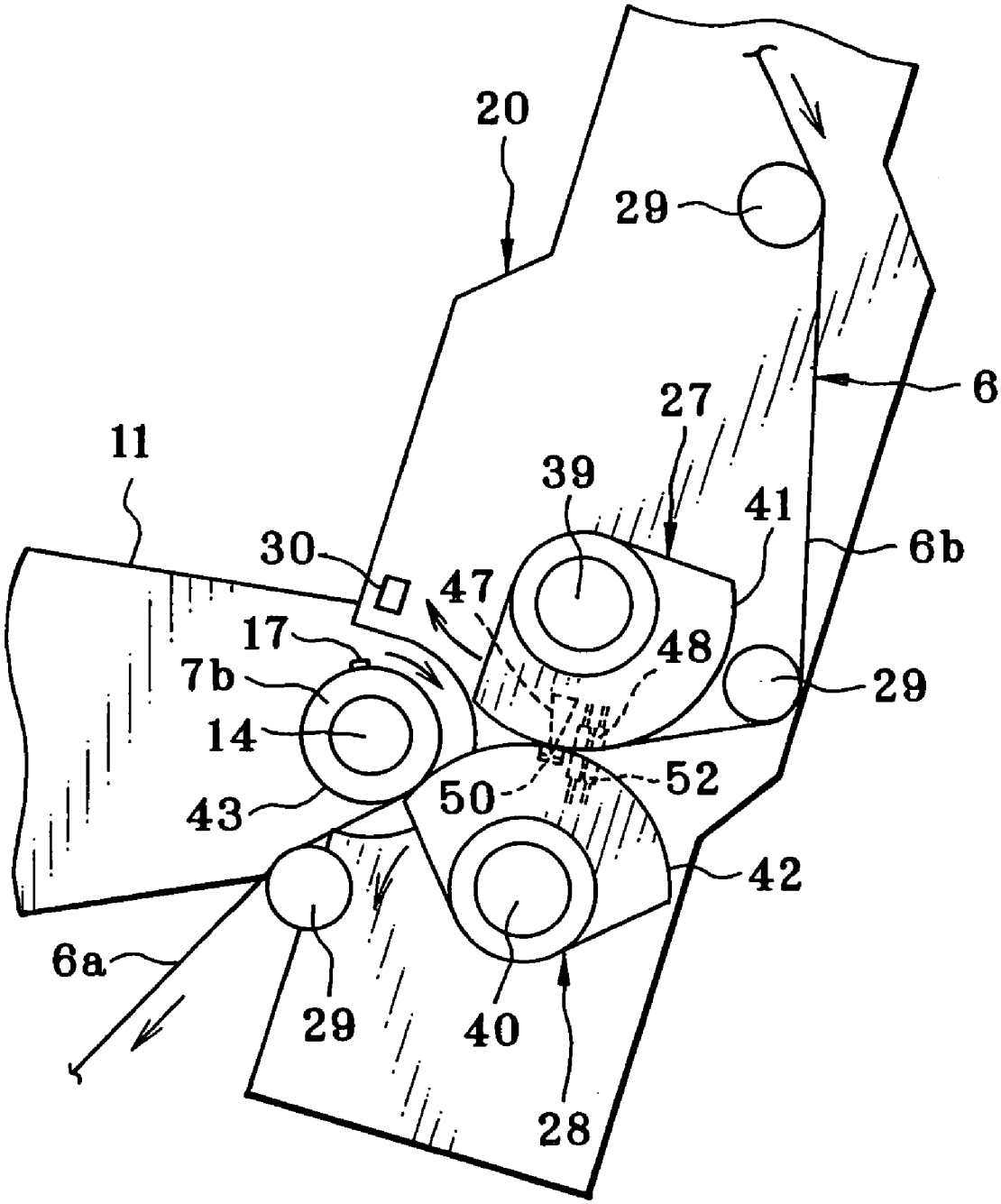
FIG. 6 is a front elevation, partially broken, illustrating a state of cutting the web.

See FIG. 5. Immediately after the shift of the drum support arm 20 to the changeover position, the cutting drum 27 and the receiving drum 28 remain stopped. The web 6 is wound about the first spindle 7*a* that is in the second turret position. When the cutting and receiving drums 27 and 28 start rotation, the web 6 becomes nipped between those at first. When the cutting and receiving drums 27 and 28 rotate further, the web 6 is also nipped between the second spindle 7*b* and the receiving drum 28. Note that the web 6, even while nipped, moves at the web moving speed equal to that at the time of being wound. Further rotations of the cutting and receiving drums 27 and 28 set the web 6 at a station between the cutter 47 of the cutting drum 27 and the receiving slot 50 of the receiving drum 28. The web 6 is squeezed and cut into a downstream web section 6*a* and an upstream web section 6*b* of FIG. 6. Immediately upon the cutting, the downstream web section 6*a* stands nipped between the second spindle 7*b* and the receiving drum 28. The upstream web section 6*b* stands nipped between the cutting and receiving drums 27 and 28.

The downstream web section 6*a* is nipped at a point downstream from the cutting position. No unstable movement occurs to the cut end of the downstream web section 6*a*. The downstream web section 6*a* is transported while nipped between the second spindle 7*b* and the receiving drum 28. After the downstream web section 6*a* is released from being nipped between the second spindle 7*b* and the receiving drum 28, the downstream web section 6*a* is wound about the first spindle 7*a*. See FIG. 7.

Figure 7:
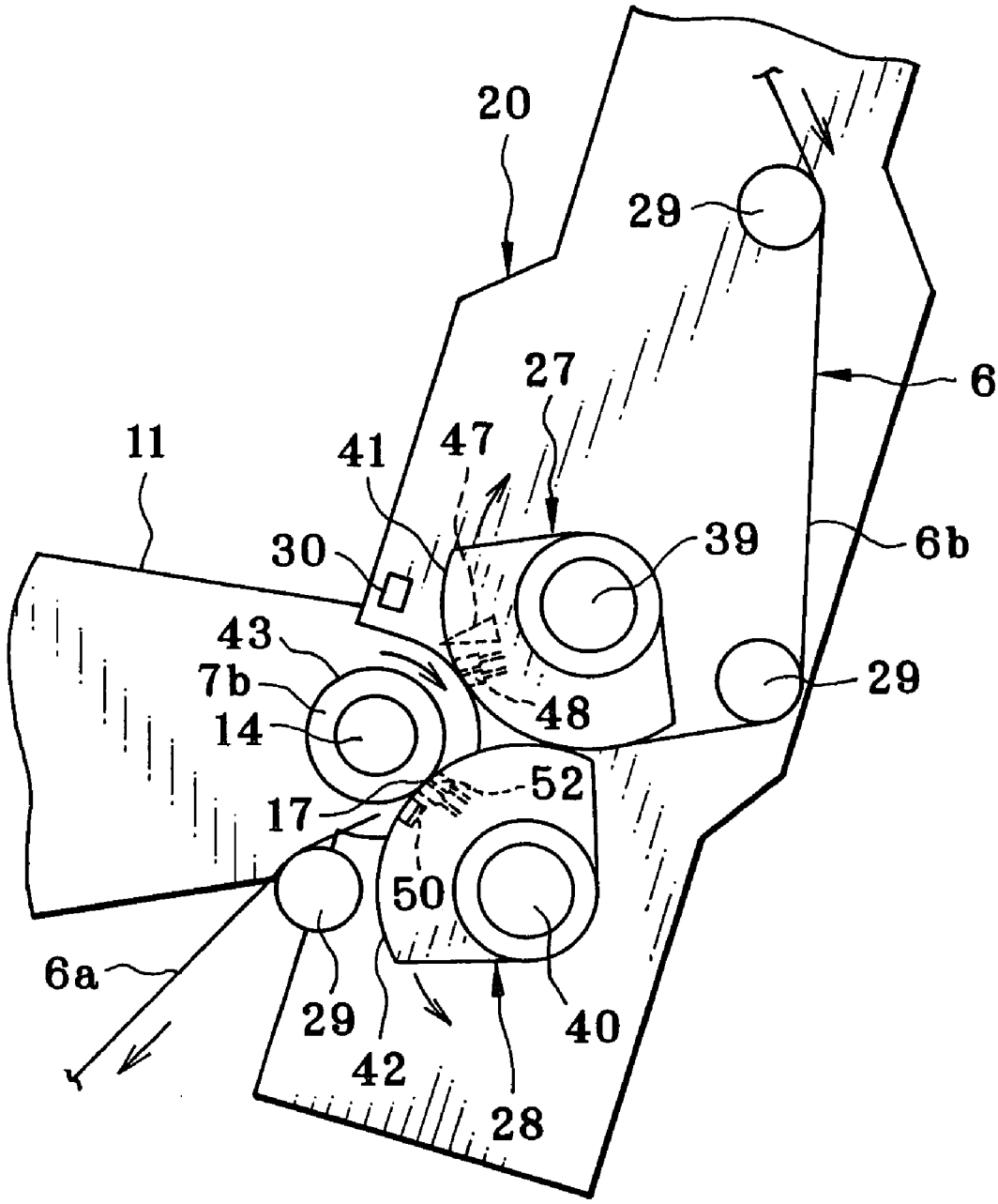
FIG. 7 is a front elevation, partially broken, illustrating a state of adhesion of the web to a second spindle.
Figure 8:
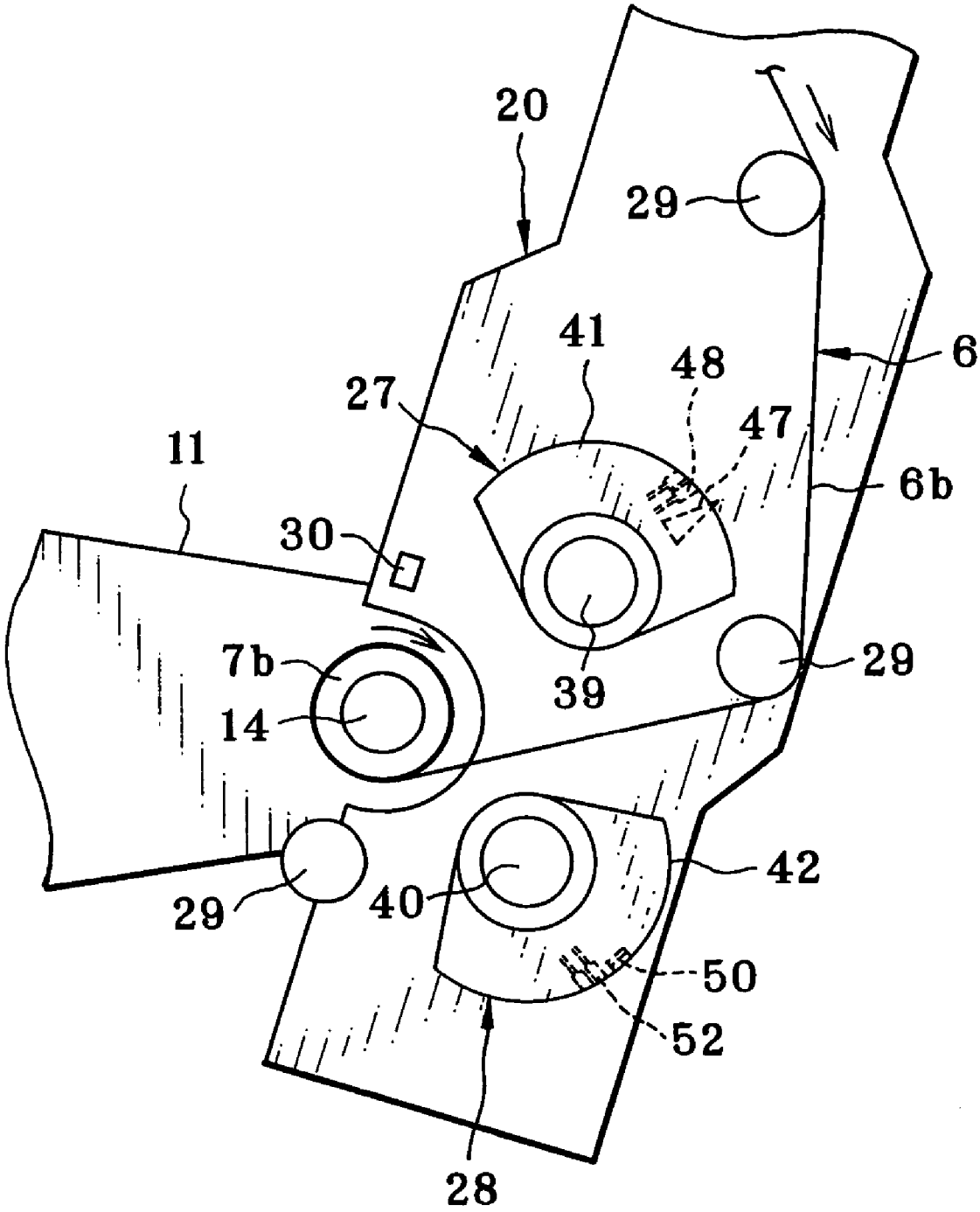
FIG. 8 is a front elevation, partially broken, illustrating a state of winding of an upstream web section.

On the other hand, the upstream web section 6*b* is thrust toward the receiving drum 28 upon application of biasing force of the blowing air from the air nozzles 48 to the front end of the upstream web section 6*b*, at the same time as the cutting. In the suction unit or suction mechanism 52 at the receiving drum 28, air is sucked to retain the front end of the upstream web section 6*b*. The front end of the upstream web section 6*b* is transported by rotation of the receiving drum 28. In FIG. 7, the front end becomes nipped between the receiving drum 28 and the second spindle 7*b* in the unloaded state. Upon the nipping operation of the upstream web section 6*b*, the front end of the upstream web section 6*b* is placed on and connected with the double-sided adhesive tape 17 on the second spindle 7*b*. As the force of suction of the suction mechanism 52 being lower than the force of adhesion with the double-sided adhesive tape 17, the front end of the upstream web section 6*b* remains attached on the second spindle 7*b*. In FIG. 8, the upstream web section 6*b* becomes wound about the second spindle 7*b*. The drum support arm 20 remains in the changeover position until a portion of the upstream web section 6*b* being wound on the second spindle 7*b* comes up to a predetermined amount.

Figure 9:
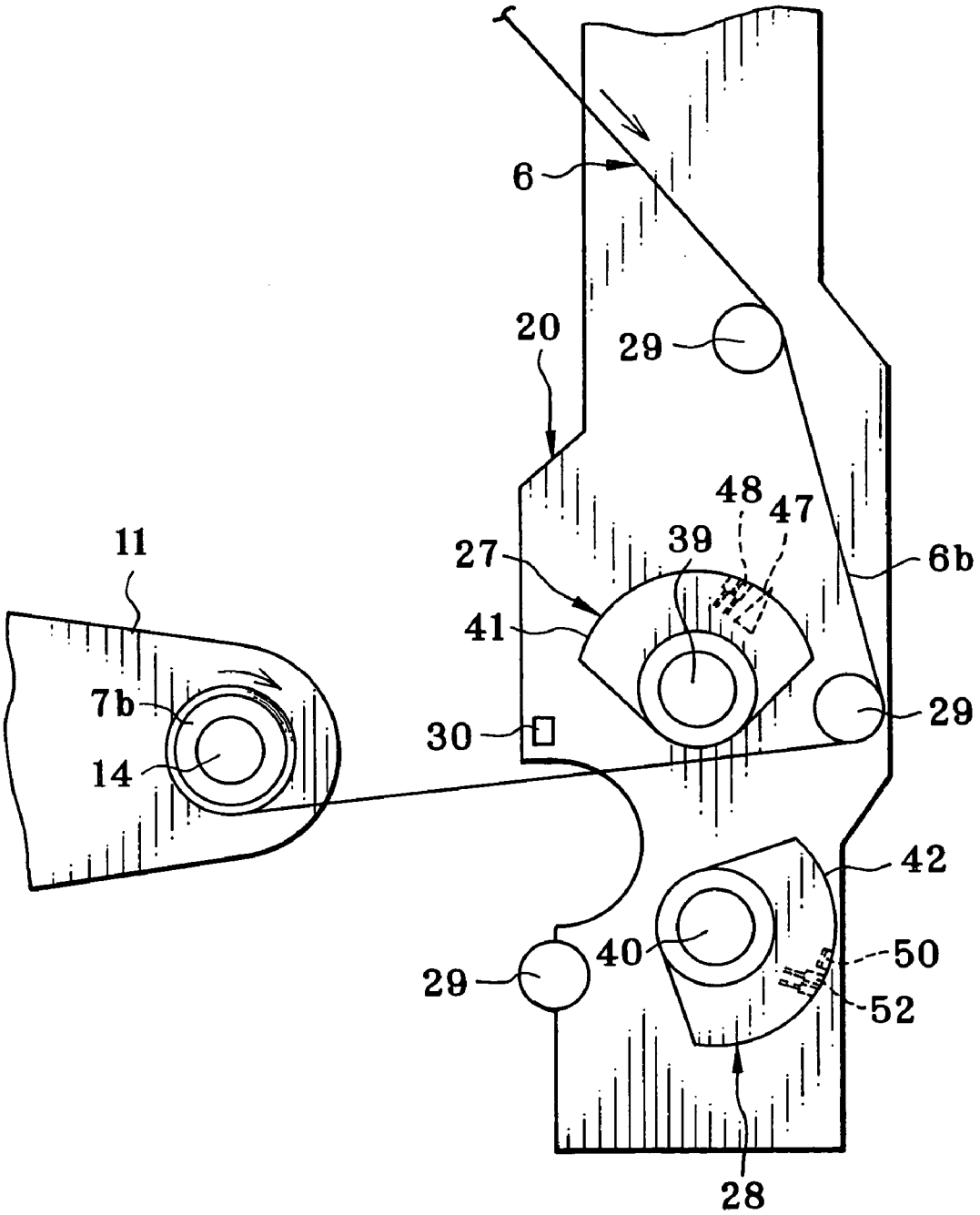
FIG. 9 is a front elevation, partially broken, illustrating a state of shifting a drum support arm in a ready position.
Figure 10:
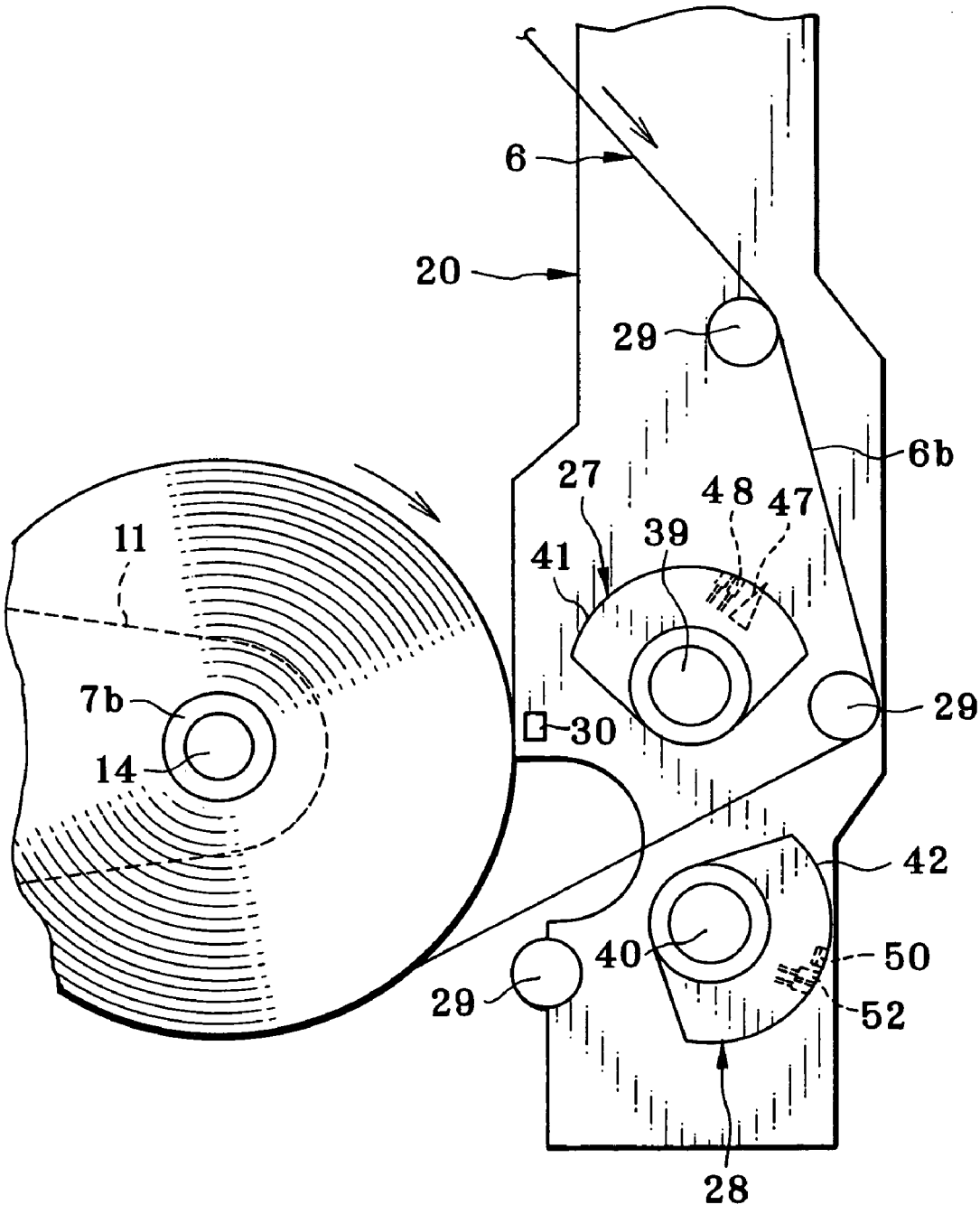
FIG. 10 is a front elevation, partially broken, illustrating a fully wound state of a roll of the web.

When an amount of a portion wound about the second spindle 7*b* comes up to the predetermined length, the controller 15 sends a control signal to the shifting cylinder 33. In FIG. 9, the drum support arm 20 shifts from the changeover position to the ready position. After this, the upstream web section 6*b* is wound until the web roll comes to have the fully wound state in FIG. 10. Similar operation is repeated until the transport of the web 6 is stopped.

Figure 11:
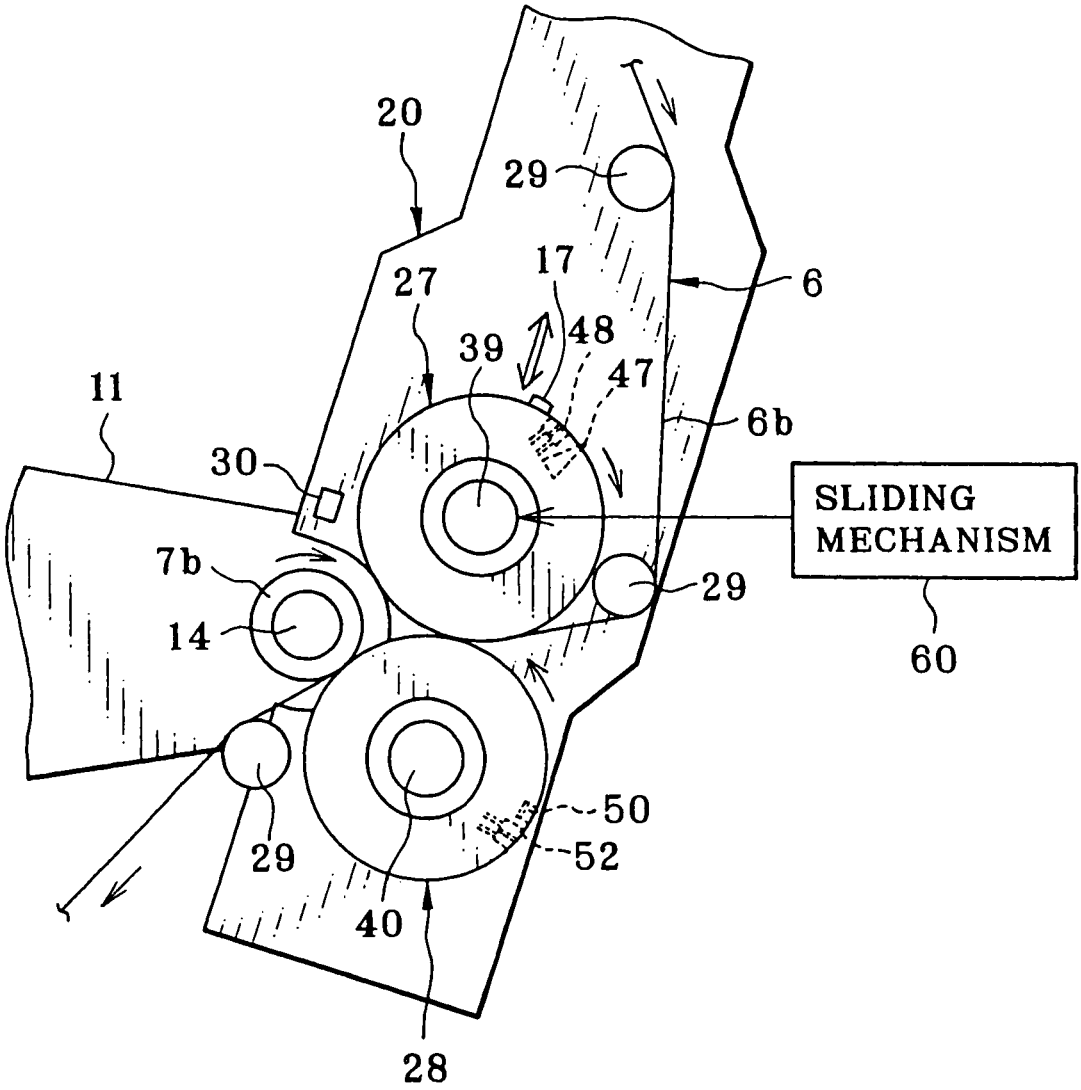
FIG. 11 is a front elevation, partially broken, illustrating another preferred changeover device having drums with a circular shape as viewed in section.

In the present embodiment, the form of the cutting drum 27 and the receiving drum 28 as viewed in a cross section is a sector shape. However, the form of those as viewed in a cross section can be circular as illustrated in FIG. 11. The drum shaft 39 may be moved by a sliding mechanism 60 or other a drum retracting mechanism, in an upward direction in the drawing sheet. This is a path forming unit in place of the drum shaft 39 defined as a surface of the cutout portion according to the above embodiment. Furthermore, the receiving drum 28 may be moved away at the same time as the cutting drum 27 is moved.

In the above embodiment, the double-sided adhesive tape 17 is previously placed on the second spindle 7*b*. However, it is also possible to set the double-sided adhesive tape 17 previously on the cutting drum 27. In this case, the double-sided adhesive tape 17 is stuck to the drum peripheral surface 41 in the vicinity of the cutter. The double-sided adhesive tape 17 is provided with force of adhesion higher on an adhesion surface to the web than on an adhesion surface for sticking to the cutting drum. At the time of release of the nipping of the upstream web section 6*b* from the cutting drum 27 and the receiving drum 28, the force of suction of the suction mechanism 52 is set high. At the time of release of the nipping of the upstream web section 6*b* from the second spindle 7*b* and the receiving drum 28, the force of suction of the suction mechanism 52 is set low. At the same time as the cutting, the double-sided adhesive tape 17 is attached to the upstream web section 6*b*. The upstream web section 6*b*, when released from nipping between the cutting and receiving drums 27 and 28, is retained on the receiving drum 28 by suction together with the double-sided adhesive tape 17. After this, the upstream web section 6*b* becomes nipped between the second spindle 7*b* and the receiving drum 28. One surface of the double-sided adhesive tape 17 is attached to the second spindle 7*b*, about which the upstream web section 6*b* is wound.

EXAMPLE 1

A sample was produced experimentally. The web 6 was formed from material of triacetyl cellulose. (TAC), had a thickness of 40 microns, a web width of 1,500 mm, and tension to be applied to the web 6 was 100 N per unit width of the web 6. The web moving speed of the web 6 was 30/min. Diameters of the first and second spindles 7*a* and 7*b* were 169 mm as equal diameters. Diameters of the cutting drum 27 and the receiving drum 28 were 300 mm as equal diameters. The turret rotation control unit 16 had a width of 10 mm, and a length of 30 mm. Pressure of nipping of the receiving drum 28 to the spindle was 0.2 MPa. Results were checked. The web 6 was safely changed over from the first spindle 7*a* to the second spindle 7*b* by smooth changeover without occurrence of wrinkles, breakage or folds.

EXAMPLE 2

A sample was produced experimentally. The web 6 was formed from material of polyethylene terephthalate (PET), had a thickness of 180 microns, a web width of 1,200 mm, and tension to be applied to the web 6 was 300 N per unit width of the web 6. The web moving speed of the web 6 was 100/min. Diameters of the first and second spindles 7*a* and 7*b* were 300 mm as equal diameters. Diameters of the cutting drum 27 and the receiving drum 28 were 300 mm as equal diameters. The turret rotation control unit 16 had a width of 10 mm, and a length of 30 mm. Pressure of nipping of the receiving drum 28 to the spindle was 0.2 MPa. Results were checked. Again, the web 6 was safely changed over from the first spindle 7*a* to the second spindle 7*b* by smooth changeover without occurrence of wrinkles, breakage or folds.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A changeover device for changing over winding of a web wound about a first spindle to winding about a second spindle in a web winder of a turret winding apparatus, wherein said first spindle is secured to a first drive shaft, said second spindle is secured to a second drive shaft, positions of said first and second drive shafts are changeable in said web winder, said changeover device comprising:

a cutting drum, disposed on a first side with respect to a web path of said web, and having a cutter for cutting said web in a width direction thereof;

a receiving drum disposed on a second side with respect to said web path opposite to said first side; and a single pivotable drum support arm for supporting both said cutting and receiving drums in a manner such that peripheral surfaces of said cutting and receiving drums contact each other.

2. A changeover device as defined in claim 1, further comprising:

a shifter for shifting said drum support arm between a changeover position for causing said drum peripheral surface of said receiving drum to contact said second spindle, and a ready position for keeping said drum peripheral surface of said receiving drum away from said web becoming wound about said second spindle; and a path forming unit, disposed between said cutting and receiving drums, for enabling said web to pass in a non-contact manner from said cutting and receiving drums.

3. A changeover device as defined in claim 2, wherein at least one of said cutting and receiving drums includes:

a first portion for constituting said drum peripheral surface at least partially; and a second portion, having a smaller radius than said drum peripheral surface, for constituting said path forming unit.

4. A changeover device as defined in claim 2, further comprising a rotation control unit, actuated when said drum support arm is set in said changeover position, for causing said cutting and receiving drums to make one rotation.

5. A changeover device as defined in claim 4, wherein said rotation control unit causes said cutting and receiving drums to rotate at a peripheral speed equal to a web moving speed of said web.

6. A changeover device as defined in claim 2, wherein said path forming unit includes a mechanism for moving said cutting drum away from said receiving drum.

7. A changeover device as defined in claim 6, further comprising a rotation control unit, actuated when said drum support arm is set in said changeover position, for causing said cutting and receiving drums to make one rotation.

8. A changeover device as defined in claim 2, wherein said web finder includes:

at least first and second turret arms, disposed to extend radially from a turret axis, for supporting respectively said first and second drive shafts at ends thereof;

a turret rotation control unit for setting said first and second turret arms selectively in said first and second turret positions by rotation thereof about said turret axis;

a controller for operation in first and second steps alternately;

wherein said controller in said first step controls said first drive shaft on said first turret arm in said first turret position to wind said web about said first spindle, said second turret position being adapted to initially setting said second spindle in an unused state;

said controller in said second step drives said turret rotation control unit for rotationally setting said second turret arm in said first turret position, and for rotationally setting said first turret arm in said second turret position, to allow removal of a roll of said web being wound from said first drive shaft;

wherein said receiving drum is positioned near to said first turret position, and said drum support arm is set in said changeover position after said second step and before said first step.

9. A changeover device as defined in claim 1, wherein said web is adhered with adhesive material to one of said spindles.

10. A changeover device as defined in claim 1, wherein an adhesive sheet material is stuck to said cutting drum, for adhesion of said web to one of said spindles, and said adhesive sheet material includes a first adhesive surface for sticking to said cutting drum, and a second adhesive surface, having higher strength of adhesion than said first adhesive surface, for adhesion to said web.

11. A changeover device as defined in claim 1, wherein said cutter protrudes from said drum peripheral surface of said cutting drum, and said receiving drum includes a receiving slot for receiving entry of said cutter.

12. A changeover device as defined in claim 11, wherein said receiving drum includes a surface material of rubber positioned on said drum peripheral surface thereof.

13. A changeover device as claimed in claim 12, further comprising a suction unit for suction of said web close to an upstream edge of said receiving slot upstream with respect to a drum rotational direction of said receiving drum.

14. A changeover device as defined in claim 13, further comprising a front end biasing unit, disposed close to an upstream side of said cutter upstream with respect to a drum rotational direction of said cutting drum, for biasing a front end of said web being cut toward said receiving drum.

15. A changeover device as defined in claim 14, wherein said front end biasing unit comprises an air blowing mechanism or sponge material.

16. A changeover device as defined in claim 1, wherein said drum support arm is moveable toward said second spindle upon said position of said first and second drive shafts being changed in said web winder.

17. A changeover method of changing over winding of a web wound about a first spindle to winding about a second spindle in a web winder of a turret winding apparatus, wherein said first spindle is secured to a first drive shaft, said second spindle is secured to a second drive shaft, positions of said first and second drive shafts are changeable in said web winder, said changeover method comprising steps of:

using a cutting drum and a receiving drum, said cutting drum being disposed on a first side with respect to a web path of said web, and having a cutter for cutting said web in a width direction thereof, and a small-radius portion free from contact with said web, said receiving drum being disposed on a second side with respect to said web path opposite to said first side, and having a small-radius portion free from contact with said web;

supporting both said cutting and receiving drums with a single pivotable drum support arm in a manner such that peripheral surfaces of said cutting and receiving drums contact each other;

stopping said cutting and receiving drums when said drum peripheral surfaces thereof are opposed to each other, to form a space for passage of said web in a non-contact manner;

shifting said drum support arm between a changeover position for causing said drum peripheral surface of said receiving drum to contact said second spindle, and a ready position for keeping said drum peripheral surface of said receiving drum away from said web becoming wound about said second spindle;

upon setting said drum support arm in said changeover position, causing said cutting and receiving drums to make one rotation, to cut said web, and securing a front end of said web being formed by cutting to said second spindle, for changing over winding.

18. A changeover method as defined in claim 17, wherein said web is adhered with adhesive material to one of said spindles.

19. A changeover method as defined in claim 17, wherein an adhesive sheet material is stuck to said cutting drum, for adhesion of said web to said second spindle, and said adhesive sheet material includes a first adhesive surface for sticking to said cutting drum, and a second adhesive surface, having higher strength of adhesion than said first adhesive surface, for adhesion to said web.

20. A changeover method as defined in claim 17, wherein said drum support arm is moveable toward said second spindle upon said position of said first and second drive shafts being changed in said web winder.

* * * * *